US005575212A

United States Patent [19]

Moser et al.

[11] Patent Number: 5,575,212

[45] Date of Patent: Nov. 19, 1996

[54] APPARATUS FOR FEEDING A PRINTING PLATE TO A PRINTING MACHINE

[75] Inventors: Gernot Moser, Rüdesheim; Uwe Püschel, Heidesheim; Hans Stutzer, Geisenheim, all of Germany

[73] Assignee: MAN Roland Druckmaschinen AG

[21] Appl. No.: 536,828

[22] Filed: Sep. 29, 1995

[30] Foreign Application Priority Data

Sep. 29, 1994 [DE] Germany ..... 9415751 U

[51] Int. Cl.[6] ..... B41F 21/00

[52] U.S. Cl. ..... 101/477; 101/415.1

[58] Field of Search ..... 101/477, 415.1, 101/216, 378, 382.1, 383, DIG. 36

[56] References Cited

U.S. PATENT DOCUMENTS

| | | | |
|---|---|---|---|
| 5,197,717 | 3/1993 | Gund . | |
| 5,218,907 | 6/1993 | Komori et al. | 101/477 |
| 5,289,775 | 3/1994 | Spiegel et al. . | |
| 5,361,699 | 11/1994 | Compers . | |
| 5,394,614 | 3/1995 | Linder et al. | 101/415.1 |
| 5,440,988 | 8/1995 | Ito | 101/477 |
| 5,492,060 | 2/1996 | Haaf et al. | 101/477 |

FOREIGN PATENT DOCUMENTS

| | | |
|---|---|---|
| 2091787 | 10/1993 | Canada . |
| 4121992C2 | 4/1993 | Germany . |
| 4224832C2 | 10/1993 | Germany . |
| 4214047C2 | 4/1994 | Germany . |
| 4214049C2 | 4/1994 | Germany . |

OTHER PUBLICATIONS

*Automatisierter Plattenwechsel.* In: druckwelt 4/25. Feb. 1993, S. 24–30.

*Primary Examiner*—Eugene H. Eickholt
*Attorney, Agent, or Firm*—Leydig, Voit & Mayer, Ltd.

[57] ABSTRACT

An apparatus for feeding a printing plate to a printing machine is disclosed. The apparatus of the printing machine includes a guard plate connected to the frame and moveable between a first position which impedes access to the interior of the printing machine and a second position which allows access to the interior of the printing machine. The apparatus further includes a support bracket pivotally connected to the guard plate and articulating means for permitting movement of the support bracket with respect to the guard plate between a first, essentially vertical position supporting the printing plate in a ready position and a second, inclined position for feeding the printing plate to the printing machine.

10 Claims, 6 Drawing Sheets

18
4
7
2
1
6
8
9
3
5
19

APPARATUS FOR FEEDING A PRINTING PLATE TO A PRINTING MACHINE

TECHICAL FIELD OF THE INVENTION

The present invention relates to an apparatus for feeding a printing plate to the plate cylinder of a printing machine.

BACKGROUND OF THE INVENTION

Sheet-fed offset printing machines comprise a plate cylinder onto which is fed a printing plate bearing a transfer image. The printing plate is clamped to a clamping rail disposed on the plate cylinder and is then drawn onto the plate cylinder by forward rotation of the plate cylinder. The process of feeding a new printing plate to the printing machine can be time consuming. In order to minimize the time required to feed the printing plate onto the plate cylinder, the prior art has provided automatic clamping apparatuses. In such apparatuses, a remotely activatable actuating means fastens and pretensions the printing plate automatically. Fully automatic printing plate changing systems also have become known. In such fully automatic systems, the entire printing plate changing operation occurs automatically. Such systems, however, are expensive and susceptible to disruption.

The prior art further has provided semi-automatic printing plate changing systems, in which the clamping and tensioning of the printing plate take place by remotely controllable actuating means, but wherein the removal of an old, used printing plate from the plate cylinder and the feeding of a new printing plate onto the plate cylinder are carried out manually. For example, DE 4,214,049 C2 discloses a semi-automatic printing plate changing system in which a pivotal, vertically displacable guard plate is positioned in front of the plate cylinder. The guard plate includes retaining devices for new printing plates to be fed to the plate cylinder. The retaining devices include a roller journalled to the lower region of the guard plate, and further include one or more suction devices in the upper region of the guard plate. After the guard plate has been raised to allow access to the plate cylinder, the guard plate is pivoted. The printing plate is introduced manually into the clamping device of the plate cylinder and then is clamped. The printing plate then is drawn onto the plate cylinder by forward rotation of the plate cylinder.

This semi-automatic printing plate feeding system suffers from a number of drawbacks. First, the printing plates are required to be bent at one end, and must include venting bores, so that the suction devices release the printing plate shortly before the bent section is reached. In addition, after the end of the printing plate has been released by the suction devices, the printing plate then is guided only by the roller. As such, the end of the printing plate sags and, in some instances, is damaged on the printing side as a result. Moreover, the suction devices are prone to soiling, thus considerably reducing the retaining force thereof.

Other apparatuses for feeding a plate cylinder to a printing plate are known. For example, the R 700 sheet-fed offset printing machine of MAN Roland Druckmaschinen AG incorporates a vertically displacable guard plate for the plate cylinder, the guard plate including, on its lower edge, two stops onto which a new printing plate can be held in a ready position. To change the printing plate, the guard plate is raised to allow access to the plate cylinder. The used printing plate is removed manually from the plate cylinder, and the new printing plate is removed from the stops and introduced into the clamping rail of the plate cylinder. During such operation, care must be taken that the plate is not damaged when it is removed from the stops and fed to the plate cylinder.

It is a general object of the present invention to provide an apparatus of simple construction for feeding a printing plate to a printing machine. It is a further general object of the present invention to provide an apparatus for feeding a printing plate to a printing machine, wherein the printing plate is minimally susceptible to damage during the feeding of the printing plate to the printing machine.

BRIEF SUMMARY OF THE INVENTION

In accordance with the present invention, an apparatus for feeding a printing plate to a printing machine includes a support bracket pivotally connected to a guard plate for supporting the printing plate in a ready position. The support bracket may be articulated with respect to the guard plate between a first, essentially vertical position supporting the printing plate in a ready position and a second, inclined position for feeding the printing plate to the plate cylinder. Thus, the printing plate may be supported in a ready position prior to feeding to the printing machine. When it is desired to feed the printing plate to the printing machine, the support bracket is articulated to its inclined position, where it supports the printing plate as the printing plate is fed to the printing machine.

DESCRIPTION OF THE PREFERRED EMBODIMENTS

Figure 1:
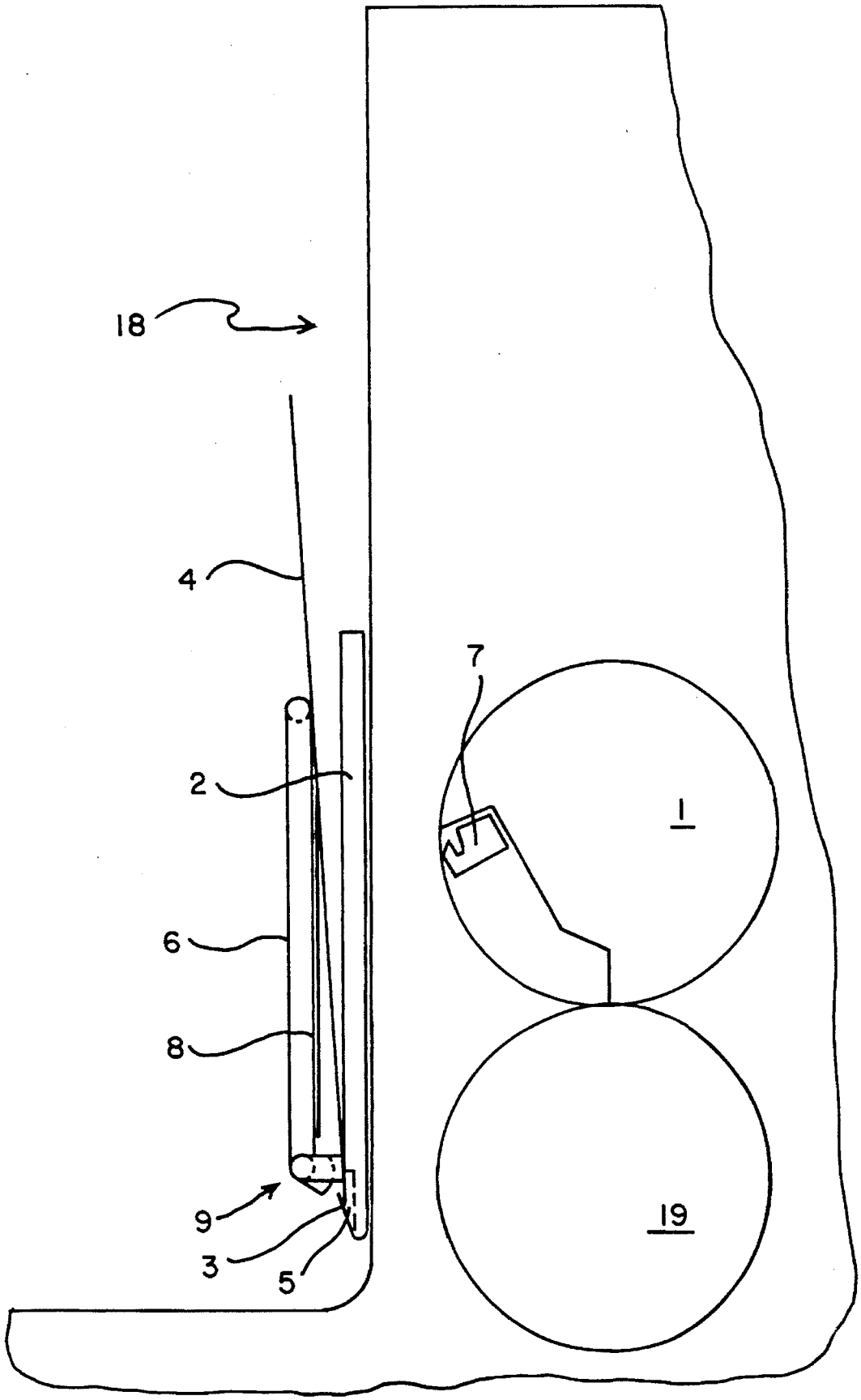
FIG. 1 is a side elevational view of a printing machine including an apparatus for feeding a printing plate to the plate cylinder of the printing machine.

FIG. 1 illustrates a printing machine 18 including a plate cylinder 1 and a rubber-blanket cylinder 19 supported within the interior of the printing machine 18. The delivery side of the printing machine is protected by a vertically displacable guard plate 2. Preferably, the guard plate 2 is mounted on the frame side walls of the printing machine 18 by rectilinear guides (not shown). In FIG. 1, the guard plate 2 is in its lowermost or operating position, wherein the guard plate 2 impedes access to the plate cylinder located within the interior of the printing machine 18. Further protective means (not shown) for protecting the delivery side of the inking unit of the printing machine are arranged above the guard plate 2.

At the lower end of the guard plate 2 two laterally spaced-apart stops 3 are disposed which may take the form of supporting hooks. A new printing plate 4 which is to be fed to the printing machine 18 can be held in a ready position on the stops 3. Disposed on the underside of the guard plate 2 is a hand grip 5 which is surrounded by a hollow space and by means of which the guard plate 2 can be manually displaced. Power means for automatically displacing the guard plate 2 also may be provided, if desired.

To support the printing plate 4 in the ready position, the apparatus includes a support bracket 6, which is pivotally mounted to the guard plate 2 at a pair of rotary joints 9 (one of which is shown in FIG. 1). As shown in FIG. 1, the support bracket 6 is pivoted into an essentially vertical position in order to retain the new printing plate 4 in a ready position.

Figure 2:
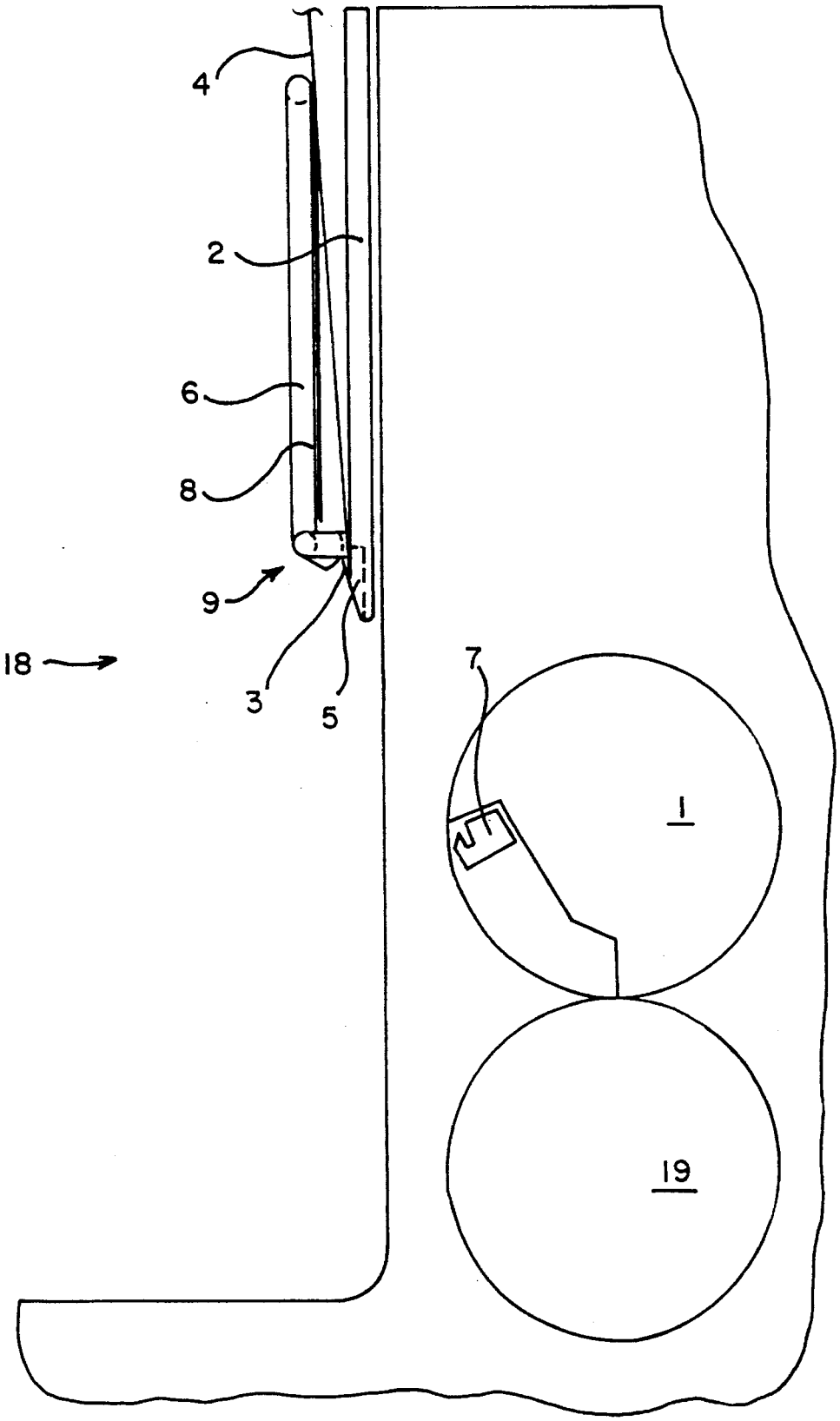
FIG. 2 is a side elevational view of the printing machine illustrated in FIG. 1, showing the guard plate raised in preparation for feeding the printing plate to the printing machine.

FIG. 2 illustrates the guard plate 2 raised so as to allow access to the interior of the printing machine 18 and to the plate cylinder 1 located therein. The support bracket 6 still is in an essentially vertical position for supporting the new printing plate 4 in a ready position.

Figure 3:
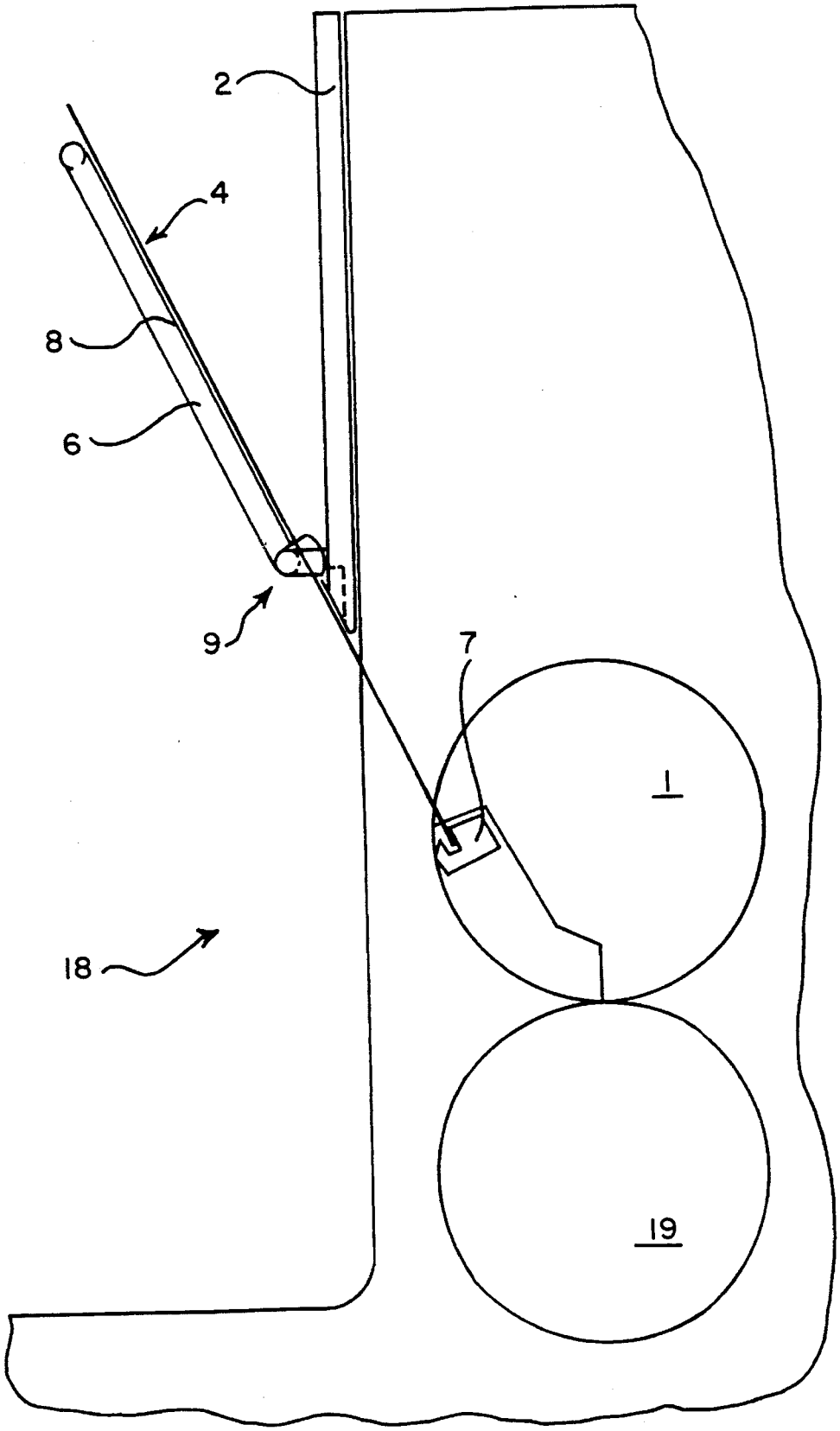
FIG. 3 is a side elevational view of the printing machine illustrated in FIG. 1, illustrating the method of feeding a printing plate to the plate cylinder of the printing machine.

FIG. 3 illustrates the feeding of the printing plate 4 into the printing machine 18. The support bracket 6 is articulated to an inclined position. The printing plate 4 then is removed from the stops 3 and fed to the plate cylinder 1. The articulation of the support bracket 6 with respect to the guard plate 2 makes it possible for the new printing plate 4 to be fed in the plane running obliquely with respect to the direction in which the guard plate 2 extends. The printing plate 4 thus is positioned so that it may be fed to the clamping rail 7 of the plate cylinder 1. The leading edge of the printing plate then is clamped, either manually or by a remote control. By rotating the plate cylinder 1 forwardly, the printing plate 4 is then drawn onto the plate cylinder 1. The printing plate 4 is supported by the support bracket 6 during this operation.

Figure 4:
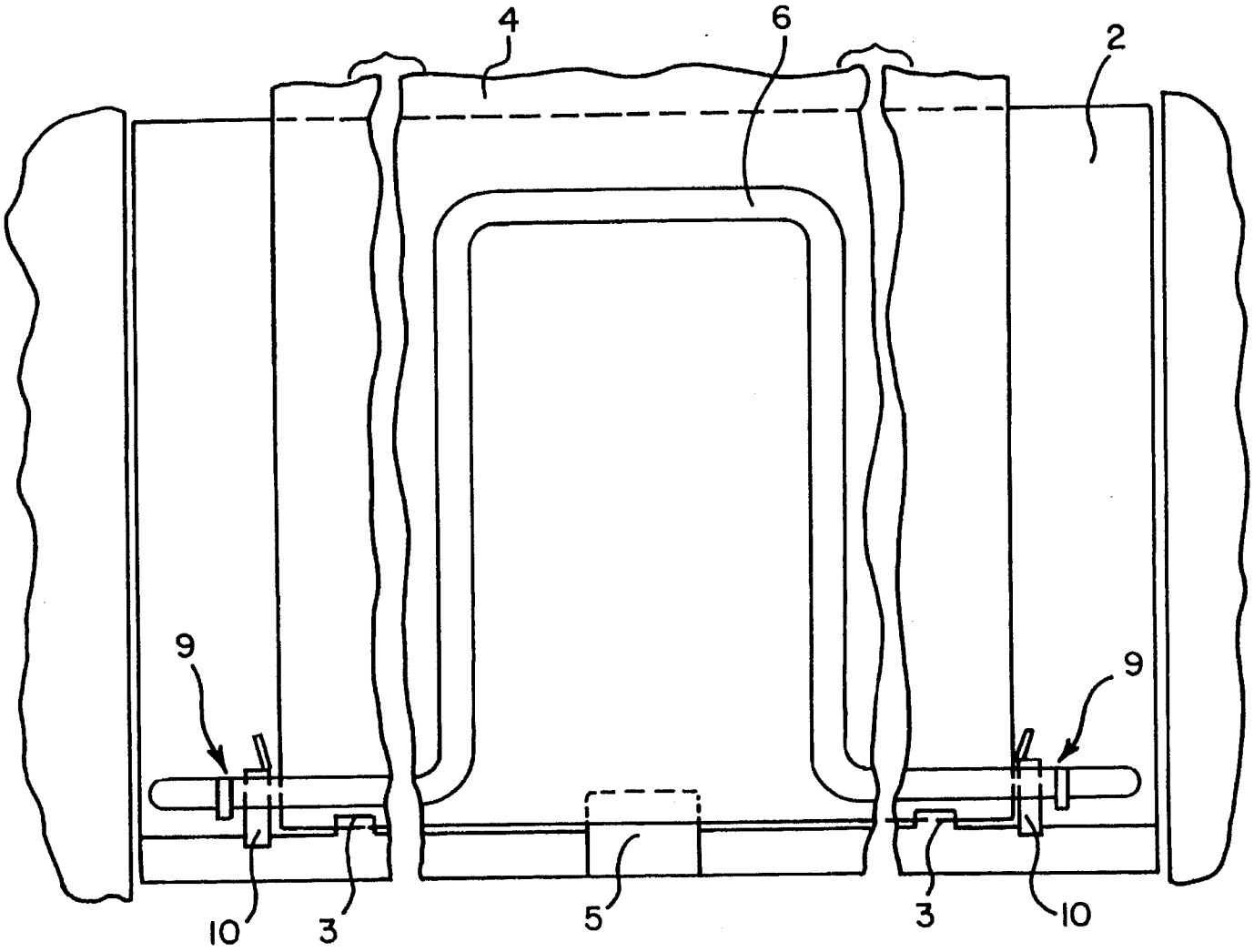
FIG. 4 is a front elevational view of the apparatus shown in FIGS. 1–3.
Figure 5:
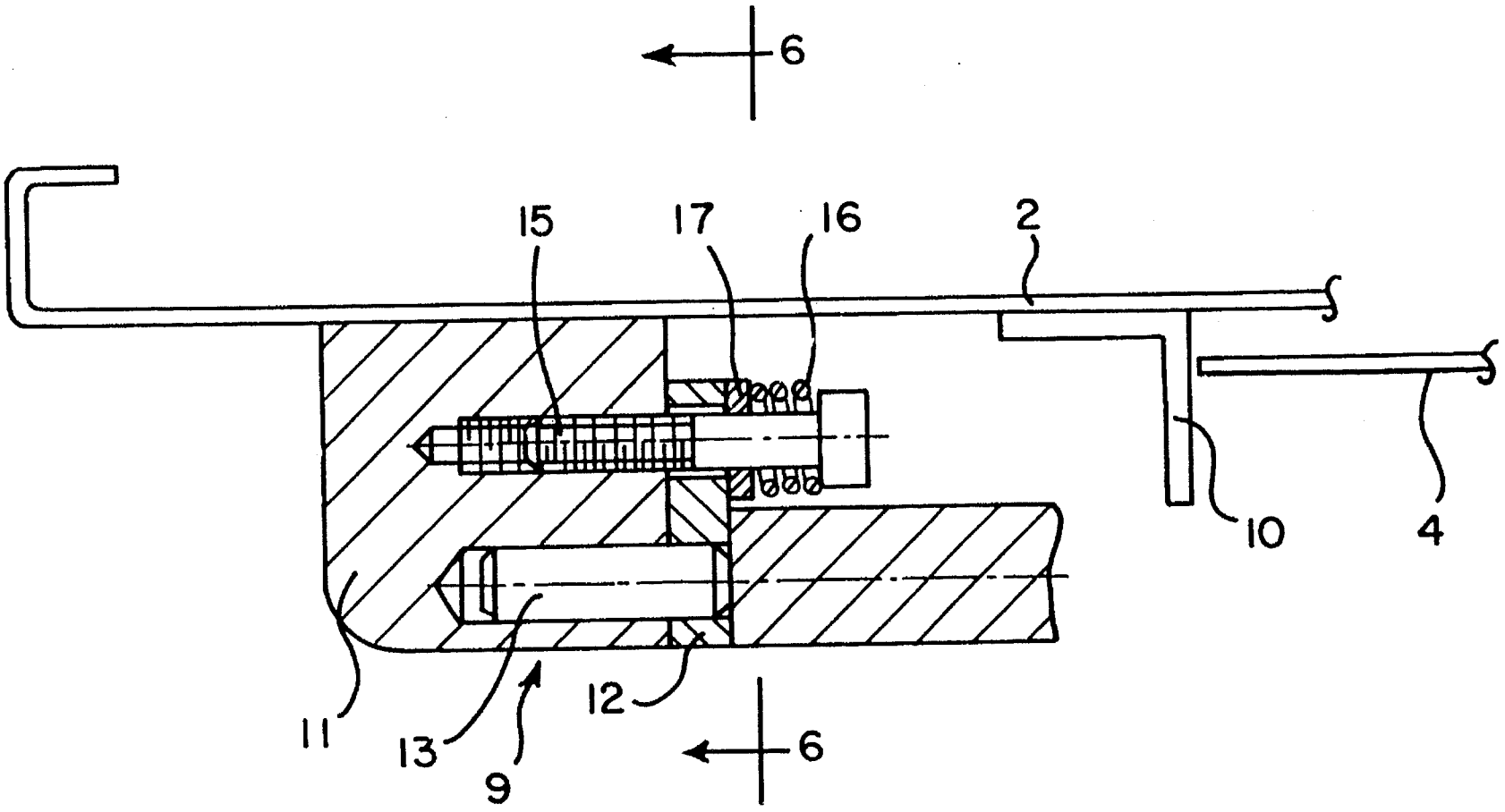
FIG. 5 is an enlarged, cross-sectional view of an articulation means used in the apparatus of the present invention.

As shown in FIG. 4, the support bracket 6 preferably has a substantially circular cross-section, and preferably has a generally inverted U-shaped configuration. At least one side stop 10 is provided on the lower end of the guard plate 2, by means of which the printing plate 4 can be laterally aligned with respect to the plate cylinder 1 both when the printing plate 4 is in its ready position and when the printing plate 4 is removed from the stops 3 and introduced to the plate cylinder 1. Preferably, two side stops 10 are provided and in the illustrated embodiment are configured essentially as angle plates, as shown in FIG. 5. Preferably, for adaptation to different plate formats, at least one of the side stops 10 is moveable in a direction parallel to the axis of the plate cylinder.

FIG. 5 illustrates a joint 9 for articulating the support bracket 6 with respect to the guard plate 2. As shown in FIG. 5, the horizontally disposed legs of the support bracket each terminate at a block 11 attached to the guard plate 2. The support bracket 6 includes a plate 12 having a bore aligned with respect to the axis of the tube of the support bracket 6. The block 11 includes a pin 13, which penetrates into the bore of the plate 12. In conjunction with the bore in the plate 12, the pin 13 thus forms the rotary joint 9 for the support bracket 6.

Figure 6:
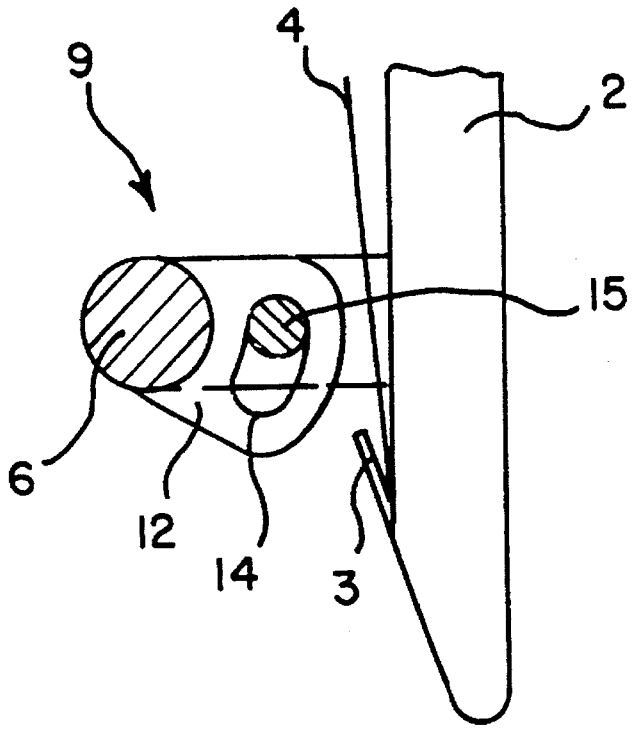
FIG. 6 is a cross-sectional view of the articulation means shown in FIG. 5 along line 6—6 in FIG. 5.

FIG. 6 shows the joint 9 and the lower part of the guard plate 2. The plate 12 includes an arcuate slot 14 for engaging the shank of a adjustable screw 15 screwed into the block 11. The arcuate slot corresponds to the articulated path of the support bracket, and thereby regulates the articulation of the support bracket 6 with respect to the guard plate 2. FIG. 6 represents the position of the support bracket 6 as shown in FIGS. 1 and 2, i.e., when the support bracket is in an essentially vertical position.

As shown in FIG. 5, a spring means is supported on the head of the adjustable screw 15. The spring means biases a washer 17 against the plate 12. Accordingly, the support bracket may be selectively moved to and held in a position between the vertical ready position and the inclined feed position. Preferably, an identical, but mirror-image inverted joint is disposed on the opposite side of the guard plate 2. The joints 9 preferably are spaced apart to leave a gap wider than the largest printing plate that the printing machine 18 is designed to accommodate.

Figure 7:
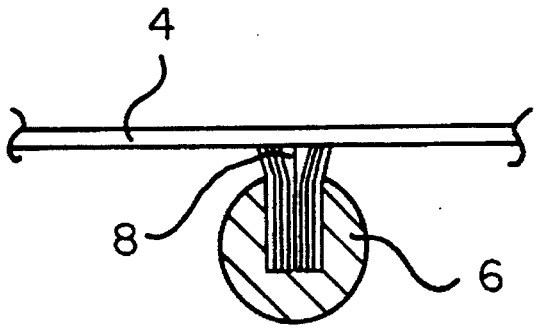
FIG. 7 is a cross-sectional view of a support bracket used in the apparatus of the present invention.

FIG. 7 illustrates a preferred construction of the support bracket 6. To prevent damage to the printing plate 4 as it is fed to the printing machine, the support bracket 6 includes one or more brushes 8 (one shown in FIG. 7). The brushes are disposed on the support bracket on the printing plate side for engaging the printing plate. Preferably, the brushes 8 are disposed within a grove in the support bracket 6.

While particular embodiments of the invention have been shown, it will of course be understood that the invention is not limited thereto since modifications may be made by those skilled in the art, particularly in light of the foregoing teachings. For example, support brackets other than the essentially U-shaped support bracket illustrated herein may be used. It is, therefore, contemplated by the appended claims to cover any such modifications as incorporate those features which constitute the essential features of these improvements within the true spirit and scope of the invention. All references cited herein are hereby incorporated by reference in their entireties.

What is claimed is:

1. An apparatus for feeding a printing plate to a printing machine, said printing machine including a frame defining an interior and supporting a plate cylinder therein for receiving said printing plate, the apparatus comprising:

a guard plate connected to said frame and moveable between a first position which impedes access to said interior of said printing machine and said plate cylinder and a second position which allows access to said interior of said printing machine and said plate cylinder, said guard plate including at least one stop for holding said printing plate in a ready position;

a support bracket pivotally connected to said guard plate for supporting said printing plate in said ready position when said guard plate is in said second position; and articulating means for pivotally connecting said support bracket to said guard plate, said articulating means permitting movement of said support bracket with respect to said guard plate between a first, essentially vertical position supporting said printing plate in said ready position and a second, inclined position for feeding said printing plate to said plate cylinder.

2. An apparatus according to claim 1, wherein said support bracket has a generally inverted U-shaped configuration.

3. An apparatus according to claim 2, wherein said support bracket has a substantially circular cross-section.

4. An apparatus according to claim 2, wherein said support bracket has a printing plate side and a non-printing plate side, and wherein said support bracket includes at least one brush disposed on said printing plate side for engaging said printing plate.

5. An apparatus according to claim 4, including a plurality of brushes disposed on said printing plate side of said support bracket for engaging said printing plate.

6. An apparatus according to claim 1, wherein said guard plate includes at least one side stop for aligning said printing plate.

7. An apparatus device according to claim 6, wherein said side stop is moveable in a direction parallel to the axis of said plate cylinder.

8. An apparatus according to claim 1, wherein said articulating means includes a spindle on said support bracket and means defining a bore disposed on said guard plate for receiving said spindle to thereby form a rotary joint for articulation of said support bracket on said guard plate.

9. An apparatus according to claim 8, wherein said articulating means includes a block mounted on said guard plate, said block including a protruding pin, said support bracket including a plate having an arcuate slot therein for engaging said protruding pin and corresponding to the articulated path of said support bracket to thereby regulate the articulation of said support bracket with respect to said guard plate.

10. An apparatus according to claim 9, wherein said protruding pin is an adjustable screw threaded into said block, said screw having a head supporting spring means for biasing a washer against said plate, whereby said support bracket may be selectively moved to and held in position between said vertical ready position and said inclined feed position.

* * * * *